United States Patent [19]

Baker et al.

[11] Patent Number: 4,770,815

[45] Date of Patent: Sep. 13, 1988

[54] DETERGENT PLUS SOFTENER WITH IMIDAZOLINE INGREDIENT

[75] Inventors: Ellen S. Baker; Roy C. Mast; Frederick A. Hartman; James R. Tucker, all of Cincinnati, Ohio

[73] Assignee: The Procter & Gamble Company, Cincinnati, Ohio

[21] Appl. No.: 922,912

[22] Filed: Oct. 24, 1986

[51] Int. Cl.[4] ..... C11D 3/28

[52] U.S. Cl. ..... 252/542; 252/8.6; 252/8.8; 252/95; 252/99; 252/135; 252/140; 252/524; 252/525; 252/544; 252/174.25; 252/186.25

[58] Field of Search ..... 252/95, 99, 102, 135, 252/524, 525, 544, 540, 542, 140, 174.25, 174.12, 8.6, 8.8, 186.25

[56] References Cited

U.S. PATENT DOCUMENTS

| | | | |
|---|---|---|---|
| 3,936,537 | 2/1976 | Baskerville, Jr. et al. | 427/242 |
| 4,294,710 | 10/1981 | Hardy et al. | 252/8.8 |
| 4,412,934 | 11/1983 | Chung et al. | 252/95 |
| 4,589,988 | 5/1986 | Rieck et al. | 252/8.8 |
| 4,661,269 | 4/1987 | Trinh et al. | 252/8.8 |

*Primary Examiner*—Paul Lieberman
*Assistant Examiner*—Hoa Van Le
*Attorney, Agent, or Firm*—David K. Dabbiere; Leonard W. Lewis; Steven J. Goldstein

[57] ABSTRACT

Disclosed are detergent compositions containing an imidazoline component. These detergent compositions provide excellent cleaning as well as fabric care benefits. The imidazoline component consists of particles having an average particle diameter of from about 20 to about 200 microns. These granular detergent compositions may optionally contain clay materials, detergent builders, chelating agents, and/or peroxygen bleaching agents.

40 Claims, No Drawings

DETERGENT PLUS SOFTENER WITH IMIDAZOLINE INGREDIENT

TECHNICAL FIELD

This invention relates to detergent compositions which impart fabric softening benefits through the wash.

BACKGROUND OF THE INVENTION

Numerous attempts have been made to formulate laundry detergent compositions which provide the good cleaning performance expected of them and which also have good textile softening properties. Attempts have been made to incorporate cationic textile softeners in anionic surfactant-based built detergent compositions employing various means of overcoming the natural antagonism between the anionic and cationic surfactants. For instance, U.S. Pat. No. 3,936,537, Baskerville et al., issued Feb. 3, 1976, discloses detergent compositions comprising organic surfactant, builders, and, in particulate form (10 to 500 microns), a quaternary ammonium softener combined with a poorly water-soluble dispersion inhibitor which inhibits premature dispersion of the cationic in the wash liquor. Even in these compositions some compromise between cleaning and softening effectiveness has to be accepted. Another approach to provide built detergent compositions with softening ability has been to employ nonionic surfactants (instead of anionic surfactants) with cationic softeners. Compositions of this type have been described in, for example, German Pat. No. 1,220,956, assigned to Henkel, issued Apr. 4, 1964; and in U.S. Pat. No. 3,607,763, Salmen et al., issued Sept. 21, 1971. However, the detergency benefits of nonionic surfactants are inferior to those of anionic surfactants.

Other laundry detergent compositions have employed tertiary amines along with anionic surfactants to act as textile softeners. British Pat. No. 1,514,276 Kengon, published June 14, 1978, employs certain tertiary amines with two long chain alkyl or alkenyl groups and one short chain alkyl group. These amines are useful as fabric softeners in detergent compositions when their isoelectric point is such that they are present as a dispersion of negatively charged droplets in the normally alkaline wash liquor, and in a more cationic form at the lower pH of a rinse liquor, and so become substantive to fabrics. The use of such amines, among others, in detergent compositions has also been previously disclosed in British Pat. No. 1,286,054, assigned to Colgate-Palmolive, published Aug. 16, 1972.

Another approach to provide anionic detergent compositions with textile softening ability has been the use of smectite-type clays, as described in U.S. Pat. No. 4,062,647, Storm et al., issued Dec. 13, 1977. These compositions, although they clean well, require large contents of clay for effective softening. The use of clay together with a water-insoluble cationic compound in an electrically conductive metal salt as a softening composition adapted for use with anionic, nonionic, zwitterionic and amphoteric surfactants has been described in British Pat. No. 1,483,627, assigned to Procter & Gamble, published Aug. 24, 1977.

Laundry detergents containing imidazolines have been disclosed before. See, for example, U.S. Pat. No. 4,589,988, Rieck et al., issued May 20, 1986, which discloses granular laundry detergents containing a combination of surfactant, and a softener system comprising amine or imidazoline and a phyllosilicate. The amine or imidazoline component is adsorbed onto the clay silicate particles. U.S. Pat. No. 4,294,710, Hardy, et al., issued Oct. 13, 1981, discloses granular laundry detergents containing a combination of surfactants along with tertiary amines or imidazoline derivatives. Generally, such detergent compositions are prepared such that the amine is sprayed onto the particulate detergent components. This reference does not recognize the criticality of particle size of the imidazoline for imparting fabric care benefits.

It is therefore an object of the present invention to provide a laundry detergent containing surfactant and imidazoline particles with an average particle size diameter of from about 20 to about 200 microns, which provides excellent through-the-wash fabric care benefits without impairing cleaning performance. Such fabric care benefits include static control and fabric softening.

SUMMARY OF THE INVENTION

The present invention relates to granular detergent compositions comprising:

(a) from about 1% to about 95% of a surfactant selected from the group consisting of anionic surfactants, cationic surfactants, nonionic surfactants, zwitterionic surfactants, amphoteric surfactants and mixtures thereof; and (b) from about 0.5% to about 25% of particles having an average diameter of from about 20 to about 200 microns, consisting of an imidazoline compound having the formula:

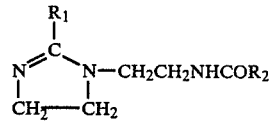

wherein each $R_1$ and $R_2$ can independently be $C_{12}$ to $C_{20}$ hydrocarbyls. Preferred imidazolines include those where $R_1$ and $R_2$ are independently chosen from $C_{14}$ to $C_{20}$ alkyl or alkenyl, more preferably $C_{16}$ to $C_{20}$ alkane and even more preferably $C_{16}$ to $C_{18}$ alkyl. The preferred surfactants are anionic surfactants. These detergent compositions can optionally contain clay softening materials, detergent builders, chelating agents and/or peroxygen bleaching agents.

DETAILED DESCRIPTION OF THE INVENTION

The components of the present invention are described in detail below.

DETERGENT SURFACTANT

The amount of detergent surfactant included in the compositions of the present invention can vary from about 1% to about 95% by weight of the composition, depending upon the particular surfactant(s) used and the effects desired. Preferably, the detergent surfactant(s) comprises from about 10% to about 60% by weight of the composition. Anionic surfactants are much preferred for optimum combined cleaning and textile softening performance, but other classes of surfactants such as nonionic, ampholytic, zwitterionic, or cationic may be used. Mixtures of these surfactants can also be used.

A. Anionic Surfactants

Anionic surfactants suitable for use in the present invention are generally disclosed in U.S. Pat. No. 3,929,678, Laughlin et al., issued Dec. 30, 1975, at column 23, line 58 through column 29, line 23 and in U.S. Pat. No. 4,294,710, Hardy et al., issued Oct. 13, 1981, both of which are incorporated herein by reference. Classes of useful anionic surfactants include:

1. Ordinary alkali metal soaps, such as the sodium, potassium, ammonium and alkylolammonium salts of higher fatty acids containing from about 8 to about 24 carbon atoms, preferably from about 10 to about 20 carbon atoms. Preferred alkali metal soaps are sodium laurate, sodium stearate, sodium oleate and potassium palmitate.

2. Water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.)

Examples of this group of anionic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. No. 2,220,099, Guenther et al., issued Nov. 5, 1940, and U.S. Pat. No. 2,477,383, Lewis, issued Dec. 26, 1946. Especially useful are linear straight chain alkylbenzene sulfonates in which the average number of carbon atoms in the alkyl group is from about 11 to about 13, abbreviated as $C_{11}$–$C_{13}$LAS.

Another group of preferred anionic surfactants of this type are the alkyl polyethoxylate sulfates, particularly those in which the alkyl group contains from about 10 to about 22, preferably from about 12 to about 18 carbon atoms, and wherein the polyethoxylate chain contains from about 1 to about 15 ethoxylate moieties, preferably from about 1 to about 3 ethoxylate moieties.

Other anionic surfactants of this type include sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Also included are water-soluble salts of esters of alpha-sulfonated fatty acids containing from about 6 to about 20 carbon atoms in the fatty acid group and from about 1 to about 10 carbon atoms in the ester group; water-soluble salts of 2-acyloxyalkane-1-sulfonic acids containing from about 2 to about 9 carbon atoms in the acyl group and from about 9 to about 23 carbon atoms in the alkane moiety; alkyl ether sulfates containing from about 10 to about 20 carbon atoms in the alkyl group and from about 1 to about 30 moles of ethylene oxide; water-soluble salts of olefin sulfonates containing from about 12 to about 24 carbon atoms; and beta-alkyloxy alkane sulfonates containing from about 1 to about 3 carbon atoms in the alkyl group and from about 8 to about 20 carbon atoms in the alkane moiety.

Particularly preferred surfactants for use herein are the linear $C_{11}$–$C_{13}$ alkyl benzene sulfonates and the $C_8$–$C_{18}$ alkyl sulfates and mixtures thereof. Most preferred are mixtures of these two anionic surfactants in a weight ratio of linear alkyl benzene sulfonate to alkyl sulfate is from about 0.5:1 to about 3:1 and more preferably from about 0.5:1 to about 2:1.

3. Anionic phosphate surfactants.

4. N-alkyl substituted succinamates.

B. Nonionic Surfactants

Suitable nonionic surfactants are generally disclosed in U.S. Pat. No. 3,929,678, Laughlin et al., issued Dec. 30, 1975, at column 13, line 14 through column 16, line 6, incorporated herein by reference. Classes of useful nonionic surfactants include:

1. The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol. Examples of compounds of this type include nonyl phenol condensed with about 9.5 moles of ethylene oxide per mole of phenol; dodecyl phenol condensed with about 12 moles of ethylene oxide per mole of phenol; dinonyl phenol condensed with about 15 moles of ethylene oxide per mole of phenol; and diisooctyl phenol condensed with about 15 moles of ethylene oxide per mole of phenol. Commercially available nonionic surfactants of this type include Igepal CO-630, marketed by the GAF Corporation; and Triton X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 4 to about 10 moles of ethylene oxide per mole of alcohol. Examples of such ethoxylated alcohols include the condensation product of myristyl alcohol with about 10 moles of ethylene oxide per mole of alcohol; and the condensation product of coconut alcohol (a mixture of fatty alcohols with alkyl chains varying in length from 10 to 14 carbon atoms) with about 9 moles of ethylene oxide. Examples of commercially available nonionic surfactants of this type include Tergitol 15-S-9 (the condensation product of $C_{11}$–$C_{15}$ linear alcohol with 9 moles ethylene oxide), Tergitol 24-L-6 NMW (the condensation product of $C_{12}$–$C_{14}$ primary alcohol with 6 moles ethylene oxide with a narrow molecular weight distribution), both marketed by Union Carbide Corporation; Neodol 45-9 (the condensation product of $C_{14}$–$C_{15}$ linear alcohol with 9 moles of ethylene oxide), Neodol 23-6.5 (the condensation product of $C_{12}$–$C_{13}$ linear alcohol with 6.5 moles of ethylene oxide), Neodol 45-7 (the condensation product of $C_{14}$–$C_{15}$ linear alcohol with 7 moles of ethylene oxide), Neodol 45-4 (the condensation product of $C_{14}$–$C_{15}$ linear alcohol with 4 moles of ethylene oxide), marketed by Shell Chemical Company, and Kyro EOB (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic surfactants, marketed by Wyandotte Chemical Corporation.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

5. Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred semi-polar nonionic detergent surfactants are the amine oxide surfactants having the formula $$R^3(OR^4)_xN(\rightarrow O)(R^5)_2$$

wherein $R^3$ is an alkyl, hydroxyalkyl, or alkyl phenyl group or mixtures thereof containing from about 8 to about 22 carbon atoms; $R^4$ is an Alkenyl or hydroxyalkenyl group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

Preferred amine oxide surfactants are $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.5 to about 10, preferably from about 1.5 to about 3, most preferably from about 1.6 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

C. Ampholytic Surfactants

Ampholytic surfactants can be broadly described as aliphatic derivatives of secondary or tertiary amines, or aliphatic derivatives of heterocyclic secondary and tertiary amines in which the aliphatic radical can be straight or branched chain and wherein one of the aliphatic substituents contains from about 8 to about 18 carbon atoms and at least one of the aliphatic substituents contains an anionic water-solubilizing group, e.g., carboxy, sulfonate, sulfate. See U.S. Pat. No. 3,929,678, Laughlin et al., issued Dec. 30, 1975, column 19, line 38 through column 22, line 48, incorporated herein by reference, for examples of ampholytic surfactants useful herein.

D. Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678, Laughlin et al., issued Dec. 30, 1975, column 19, line 38 through column 22, line 48, incorporated herein by reference, for examples of zwitterionic surfactants useful herein.

E. Cationic Surfactants

Cationic surfactants can also be included in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solutions pH values less than about 8.5.

Suitable cationic surfactants include the quaternary ammonium surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain; each $R^3$ is independently selected from the group consisting of $—CH_2CH_2—$, $—CH_2CH(CH_3)—$, $—CH_2CH(CH_2OH)—$, and $—CH_2CH_2CH_2—$; each $R^4$ is independently selected from the group consisting of $C_1$–$C_4$ alkyl, $C_1$–$C_4$ hydroxyalkyl, benzyl, ring structures formed by joining the two $R^4$ groups, $—CH_2CHOHCHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred examples of the above compounds are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_8$–$C_{16}$ alkyl trimethylammonium salts, $C_8$–$C_{16}$ alkyl di(hydroxyethyl)methylammonium salts, the $C_8$–$C_{16}$ alkyl hydroxyethyldimethylammonium salts, and $C_8$–$C_{16}$ alkyloxypropyltrimethylammonium salts. Of the above, decyl trimethylammonium methylsulfate, lauryl trimethylammonium chloride, myristyl trimethylammonium bromide and coconut trimethylammonium chloride and methylsulfate are particularly preferred.

A more complete disclosure of these and other cationic surfactants useful herein can be found in U.S. Pat. No. 4,228,044, Cambre, issued Oct. 14, 1980, incorporated herein by reference.

ORGANIC SOFTENING AGENT

The softening agent of the present invention consists of various imidazoline derivatives which are incorporated into the laundry detergent compositions of the present invention.

The imidazoline compounds are highly water-insoluble particles having a diameter of from about 20 to about 200 microns of the formula:

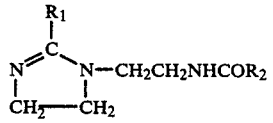

wherein $R_1$ and $R_2$ can independently be $C_{12}$ to $C_{20}$ hydrocarbyl. Therefore, $R_1$ and $R_2$ can be the same or different.

Preferred imidazoline-derivatives are those wherein $R_1$ and $R_2$ are independently $C_{12}$ to $C_{20}$ alkyl or alkenyl, and more preferably $C_{14}$ to $C_{20}$ alkyl. Suitable examples of such imidazoline derivatives include stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut-amido ethyl-2-coconut imidazoline, tallow amido ethyl-2-tallow imidazoline and mixtures of such imidazoline derivatives. More preferred are those imidazoline derivatives wherein $R_1$ and $R_2$ are independently $C_{16}$ to $C_{20}$ alkyl (e.g. wherein $R_1$ and $R_2$ are palmityl, stearyl and arachidyl). Most preferred are those imidazoline derivatives wherein $R_1$ and $R_2$ are independently $C_{16}$ to $C_{18}$ alkyl, i.e., wherein $R_1$ and $R_2$ are each derived from tallow.

These imidazoline derivatives can be manufactured, for example, from the reaction of diethylene triamine with the appropriate carboxylic acid. This procedure is set forth in *Kirk-Othmer Encyclopedia of Chemical Technology,* Third Edition, Volume 7, pages 580–600 (Grayson et al., Editors; Wiley-Interscience, N.Y., N.Y.; 1979), which is incorporated by reference herein.

Preferred $C_{16}$ to $C_{18}$ imidazoline derivatives are available from Sherex Corporation as Varisoft® 445 imidazoline. Varisoft® 445 imidazoline may contain up to 50% of non-imidazoline material (e.g., starting materials) which do not adversely affect the fabric care benefits of the present invention.

It has been found that in order for these imidazoline particles to impart their fabric care benefits they must have an average particle diameter of from about 20 to about 200 microns, preferably from about 50 to about 150 microns, more preferably from about 60 to about 125 microns, and most preferably from about 60 microns to about 110 microns. The term "average particle diameter" represents the mean particle size diameter of the actual particles of a given material. The mean is calculated on a weight percent basis. The mean is determined by conventional analytical techniques such as, for example, laser light diffraction or microscopic determination utilizing a scanning electron microscope. Preferably, greater than 50% by weight and more preferably greater than 60% by weight and most preferably greater than 70% by weight, of the particles have actual diameters which fall within the range of from about 20 to about 200 microns, preferably from about 50 to about 150 microns, more preferably from about 60 to about 125 microns, and most preferably from about 60 microns to about 110 microns. These imidazoline derivatives are generally commercially available as solid blocks and must be ground to these particle sizes.

These particle sizes can be achieved by, for example, grinding solid blocks of the imidazoline in blenders (e.g., an Oster ® blender) or in large scale mills (e.g., a Wiley ® Mill) to the desired particle size range.

A preferred method of forming appropriately-sized particles is to liquify the imidazoline and spray-dry the liquid form in a spray-drying tower to form the solid particles of the desired size. Such methods of spray-drying particles are well known to those skilled in the art.

In order to incorporate these particles into the granular detergent of the present invention, it is preferred that the individual imidazoline particles be agglomerated using any of a variety of binding agents known in the art in order to form granular-sized (e.g., 1 millimeter) particles. Such binding agents must dissolve quickly in the wash liquor. Suitable examples of binding agents include water, or water-soluble salts such as sulfates, carbonates, or phosphates. When these particles are agglomerated prior to their addition to the detergent granules, it minimizes segregation of the imidazoline particles from the remainder of the detergent composition.

It has been found that these softening agents, unlike those of the prior art, can be incorporated into the detergent compositions of the present invention with little, if any, detrimental effect on cleaning. These compositions provide fabric care benefits across a variety of laundry conditions. That is, machine or hand washing and machine drying and also machine or hand washing and line drying. Additionally, these same softening agents can be used with a variety of surfactant systems. Such surfactant systems include mixtures of all types of surfactants i.e., anionics, cationics, nonionics, zwitterionics and amphoterics. Additionally, these softening agents can be used with mixtures of surfactants that are within the same class, e.g., two different anionic surfactants. In fact, it has been found that mixed anionic surfactant systems are preferred for use in the present invention. Examples of such mixed anionic surfactant systems include linear $C_9$–$C_{15}$ alkyl benzene sulfonates and $C_{10}$–$C_{20}$ alkyl sulfate.

The detergent compositions of the present invention contain from about 0.5% to about 25%, preferably from about 1% to about 10%, most preferably from about 4% to about 8% of the imidazoline component by weight of the total composition.

DETERGENT BUILDERS

Detergent compositions of the present invention contain inorganic and/or organic detergent builders to assist in mineral hardness control. These builders comprise from 0% to about 80% by weight of the compositions. Built granular formulations preferably comprise from about 10% to about 80%, preferably about 24% to about 80%, by weight of detergent builder.

Suitable detergent builders include crystalline aluminosilicate ion exchange materials having the formula:

$$Na_z[(AlO_2)_z(SiO_2)_y].xH_2O$$

wherein z and y are at least about 6, the mole ratio of z to y is from about 1.0 to about 0.5; and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate.

The aluminosilicate ion exchange builder materials are in hydrated form and contain from about 10% to about 28% of water by weight if crystalline and potentially even higher amounts of water if amorphous. Highly preferred crystalline aluminosilicate ion exchange materials contain from about 18% to about 22% water in their crystal matrix. The preferred crystalline aluminosilicate ion exchange materials are further characterized by a particle size diameter of from about 0.1 micron to about 10 microns. Amorphous materials are often smaller, e.g., down to less than about 0.01 micron. More preferred ion exchange materials have a particle size diameter of from about 0.2 micron to about 4 microns. The crystalline aluminosilicate ion exchange materials are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials are still further characterized by their calcium exchange rate which is at least about 2 grains $CA^{++}$ /gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicates for builder purposes exhibit a calcium ion exchange rate of at least about 4 grains/gallon/minute/gram/gallon.

The amorphous aluminosiicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

Other detergency builders useful in the present invention include the alkali metal silicates, alkali metal carbonates, phosphates, polyphosphates, phosphonates, polyphosphonic acids, $C_{10-18}$ alkyl monocarboxylic acids, polycarboxylic acids, alkali metal, ammonium or substituted ammonium salts thereof and mixtures thereof. The most preferred builders for use in the present invention are the alkali metal, especially sodium, salts of these compounds.

Specific examples of inorganic phosphate builders are sodium and potassium tripolyphosphate, pyrophosphate, polymeric metaphate having a degree of polymerization of from about 6 to about 21, and orthophosphate. Examples of polyphosphonate builders are the sodium and potassium salts of ethylene-1,1-diphosphonic acid, the sodium and potassium salts of ethane 1-hydroxy-1,1-diphosphonic acid and the sodium and potassium salts of ethane-1,1,2-triphosphonic acid. Other suitable phosphorus builder compounds are disclosed in U.S. Pat. No. 3,159,581, Diehl, issued Dec. 1, 1964; U.S. Pat. No. 3,213,030, Diehl, issued Oct. 19, 1965; U.S. Pat. No. 3,400,148, Quimby, issued Sept. 3, 1968; U.S. Pat. No. 3,400,176, Quimby, issued Sept. 3, 1968; U.S. Pat. No. 3,422,021, Roy, issued Jan. 14, 1969; and U.S. Pat. No. 3,422,137, Quimby, issued Sept. 3, 1968; all herein incorporated by reference.

Examples of nonphosphorus, inorganic builders are sodium and potassium carbonate, bicarbonate, sesquicarbonate, tetraborate decahydrate, and silicate having a mole ratio of $SiO_2$ to alkali metal oxide of from about 0.5 to about 4.0, preferably from about 1.0 to about 2.4.

Useful water-soluble, nonphosphorus organic builders include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Highly preferred polycarboxylate builders are disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates disclosed in U.S. Pat. No. 3,723,322, Diehl, issued Mar. 28, 1973, incorporated herein by reference.

A class of useful phosphorus-free detergent builder materials have been found to be ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al, U.S. Pat. No. 3,635,830, issued Jan. 18, 1972, both of which are incorporated herein by reference.

A specific type of ether polycarboxylates useful as builders in the present invention are those having the general formula:

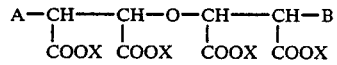

wherein A is H or OH; B is H or

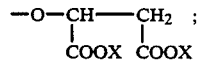

and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is

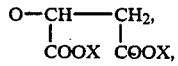

then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

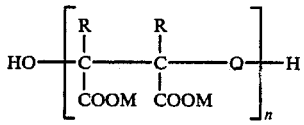

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Other useful builders include the $C_5$–$C_{20}$ alkyl succinic acids and salts thereof. A particularly preferred compound of this type is dodecenylsuccinic acid.

Useful builders also include sodium and potassium carboxymethyloxymalonate, carboxymethyloxysuccinate, cis-cyclohexanehexacarboxylate, cis-cyclopentanetetracarboxylate phloroglucinol trisulfonate, water-soluble polyacrylates (having molecular weights of from about 2,000 to about 200,000, for example), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Especially useful detergency builders include the $C_{10}$–$C_{18}$ alkyl monocarboxylic (fatty) acids and salts thereof. These fatty acids can be derived from animal and vegetable fats and oils, such as tallow, coconut oil and palm oil. Suitable saturated fatty acids can also be synthetically prepared (e.g., via the oxidation of petroleum or by hydrogenation of carbon monoxide via the Fisher-Tropsch process). Patricularly preferred $C_{10}$–$C_{18}$ alkyl monocarboxylic acids are saturated coconut fatty acids, palm kernel fatty acids, and mixtures thereof.

Other useful detergency builder materials are the "seeded builder" compositions disclosed in Belgian Pat. No. 798,856, published Oct. 29, 1973, incorporated herein by reference. Specific examples of such seeded builder mixtures are 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle of 0.01 micron; and a 3:3:1 wt. mixture of sodium carbonate, sodium aluminate and calcium oxide having a particle diameter of 5 microns.

CHELATING AGENTS

The detergent compositions herein may also optionally contain one or more iron and manganese chelating agents. Such chelating agents can be selected from the group consisting of amino carboxylates, amino phosphonates, polyfunctionally—substituted aromatic chelating agents and mixtures thereof, all as hereinafter defined. Without relying on theory, it is speculated that the benefit of these materials is due in part to their exceptional ability to remove iron and manganese ions from washing solutions by formation of soluble chelates.

Amino carboxylates useful as optional chelating agents in compositions of the invention have one or more, preferably at least two, units of the substructure

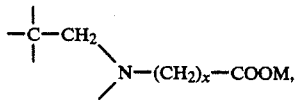

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Alkylene groups can be shared by substructures. Operable amine carboxylates include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines or mixtures thereof.

Amino phosphonates are also suitable for use as chelating agents in the compositions of the invention when at least low levels of total phosphorous are permitted in detergent compositions. Compounds with one or more, preferably at least two, units of the substructure

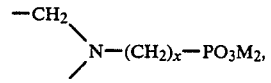

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally-substituted aromatic chelating agents are also useful in the compositions herein. These materials comprise compounds having the general formula

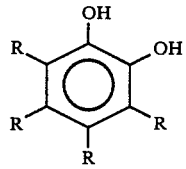

wherein at least one R is —$SO_3H$ or —COOH or soluble salts thereof and mixtures thereof. U.S. Pat. No. 3,812,044 issued May 21, 1974, to Connor et al., incorporated herein by reference, discloses polyfunctionally-substituted aromatic chelating and sequestering agents. Preferred compounds of this type in acid form are dihydroxydisulfobenzenes and 1,2-dihydroxy-3,5-disulfobenzene or other disulfonated catechols in particular. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent or laundry additive compositions herein. More preferably chelating agents will comprise from about 0.75% to about 3.0% by weight of such compositions.

BLEACHING AGENTS

The detergent compositions of the present invention can optionally contain from about 1% to about 20%, preferably about 1% to about 10% of percarboxylic acids bleaching agents or bleaching compositions containing peroxygen bleaches capable of yielding hydrogen peroxide in an aqueous solution and specific bleach activators, hereinafter defined, at specific molar ratios of hydrogen peroxide to bleach activator. These bleaching agents are fully described in U.S. Pat. No. 4,412,934, Chung et al., issued Nov. 1, 1983, and in U.S. Pat. No. 4,483,781, Hartman, issued Nov. 20, 1984, both of which are herein incorporated by reference. Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing and, thus, result in a white textile having a gray tint. These soils tend to be a blend of particulate and greasy materials. The removal of this type of soil is sometimes referred to as "dingy fabric clean up".

The bleaching compositions provide such bleaching over a wide range of bleach solution temperatures. Such bleaching is obtained in bleach solutions wherein the solution temperature is at least about 5° C. Without the bleach activator such peroxygen bleaches would be ineffective and/or impracticable at temperatures below about 60° C.

THE PEROXYGEN BLEACHING COMPOUND

The peroxygen bleaching compounds useful herein are those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono- and tetra-hydrate, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution.

Bleaching agents useful herein contain from about 0.1% to about 99.9% and preferably from about 1% to about 60% of these peroxygen bleaches.

THE BLEACH ACTIVATOR

The bleach activators within the invention have the general formula:

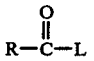

wherein R is an alkyl group containing from about 5 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 4 to about 13.

L can be essentially any suitable leaving group. A leaving group is any group that is displaced from the bleach activator as a consequence of the nucleophilic attack on the bleach activator by the perhydroxide anion. This, the perhydrolysis reaction, results in the formation of the percarboxylic acid. Generally, for a group to be a suitable leaving group it must exert an electron attracting effect. This facilitates the nucleophilic attack by the perhydroxide anion. Leaving groups that exhibit such behavior are those in which their conjugate acid has a $pK_a$ in the range of from about 4 to about 13, preferably from about 7 to about 11 and most preferably from about 8 to about 11.

Preferred bleach activators are those of the above general formula wherein R is as defined in the general formula and L is selected from the group consisting of:

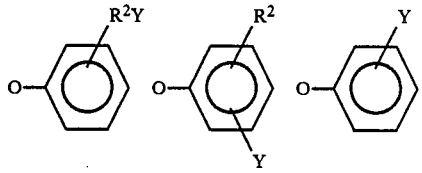

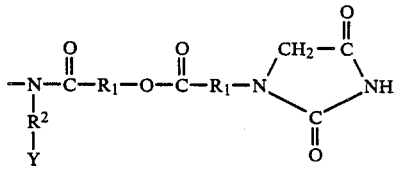

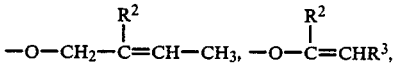

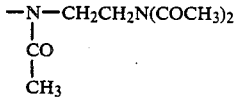

wherein R is as defined above, $R^2$ is an alkyl chain containing from about 1 to about 8 carbon atoms, $R^3$ is H or $R^2$, and Y is H or a solubilizing group. The preferred solubilizing groups are $—SO^-{}_3M^+$, $—COO^-M^+$, $—SO^{-4}M^+$, $(—N^+R^{34})X^-$ and $O—NR^{24}$ and most preferably $—SO^-{}_3M^+$ and $—COO^-M^+$ wherein $R^4$ is an alkyl chain containing from about 1 to about 4 carbon atoms, M is a cation which provides solubility to the bleach activator, and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing group should be well dispersed in the bleaching solution in order to assist in their dissolution.

Preferred bleach activators are also those of the above general formula wherein L is as defined in the general formula and R is an alkyl group containing from about 5 to about 12 carbon atoms wherein the longest linear alkyl chain extending from and including the carbonyl carbon contains from about 6 to about 10 carbon atoms.

Even more preferred are bleach activators of the above general formula wherein L is as defined in the general formula and R is a linear alkyl chain containing from about 5 to about 9 and preferably from about 6 to about 8 carbon atoms.

More preferred bleach activators are those of the above general formula wherein R is a linear alkyl chain containing from about 5 to about 9 and preferably from about 6 to about 8 carbon atoms and L is selected from the group consisting of:

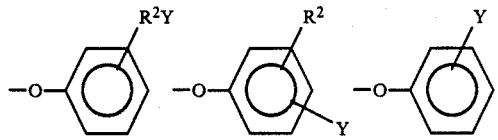

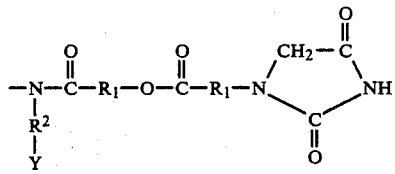

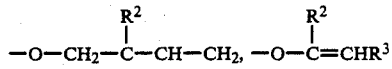

wherein R, $R^2$, $R^3$ and Y are as defined above.

Particularly preferred bleach activators are those of the above general formula wherein R is an alkyl group containing from about 5 to about 12 carbon atoms wherein the longest linear portion of the alkyl chain extending from and including the carbonyl carbon is from about 6 to about 10 carbon atoms and L is selected from the group consisting of:

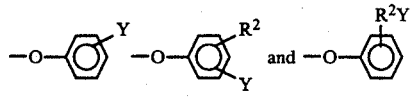

wherein $R^2$ is as defined above and Y is $—SO^-{}_3M^+$ or $—COO^-M^+$ wherein M is as defined above.

Especially preferred bleach activators are those of the above general formula wherein R is a linear alkyl chain containing from about 5 to about 9 and preferably from about 6 to about 8 carbon atoms and L is selected from the group consisting of:

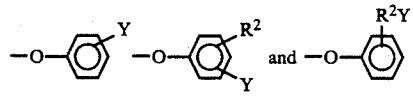

wherein $R^2$ is as defined above and Y is $—SO^-{}_3M^+$ or $—COO^-M^+$ wherein M is as defined above.

The more preferred bleach activators have the formula:

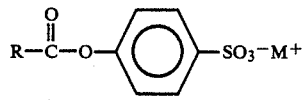

wherein R is a linear or branched alkyl chain containing from about 5 to about 9 and preferably from about 6 to about 8 carbon atoms and M is sodium or potassium. The most preferred bleach activator is sodium nonyl oxybenzene sulfonate.

These bleach activators can also be combined with up to 15% of binder materials (relative to the activator) such as nonionic surfactants, polyethylene glycols, fatty acids, anionic surfactants and mixtures thereof. Such binding materials are fully set forth in U.S. Pat. No. 4,486,327, Murphy et al., issued Dec. 4, 1984 which is incorporated by reference herein.

Bleaching agents useful herein contain from about 0.1% to about 60% and preferably from about 0.5% to about 40% of these bleach activators.

PERCARBOXYLIC ACID BLEACHING AGENTS

Bleaching agents can also comprise percarboxylic acids and salts thereof. Suitable examples of this class of agents include magnesium monoperoxyphthalate hexahydrate, the magnesium salt of meta-chloro perbenzoic acid, nonyl amino-6-oxoperoxysuccinic acid and diperoxydodecanedioic acid. Such bleaching agents are disclosed in U.S. Pat. No. 4,483,781, Hartman, issued Nov. 20, 1984, U.S. Patent Application Ser. No. 740,446, Burns et al., filed June 3, 1985 and also in European Patent Application No. 0,133,354, Banks et al., published Feb. 20, 1985, both of which are incorporated by reference herein.

SMECTITE CLAY MINERALS

A highly preferred optional component of formulations in accordance with the present invention is a smectite clay, which serves to provide additional fabric softening performance. The smectite clay particularly useful in the present invention are montmorillonites, saponites, and hectorites. The clays used herein have particle size which cannot be perceived tactilely. Impalpable clays have particle sizes below about 50 microns; the clays used herein normally have a particle size range of from about 5 microns to about 50 microns.

The clay minerals used to provide fabric conditioning properties in the instant compositions can be described as expandable (swellable), three-layer clays, in which a sheet of aluminum/oxygen atoms or magnesium/oxygen atoms lies between two layers of silicone/oxygen atoms, i.e., aluminosilicates and magnesium silicates, having an ion exchange capacity of at least about 50 meq/100 g. of clay, and preferably at least about 60 meq/100 g. of clay. The term "expandable" as used to describe clays relates to the ability of the layered clay structure to be swollen or expanded on contact with water. The three-layer expandable clays used herein are examples of the clay minerals classified geologically as smectites. Such smectite clays are described in Grim, *Clay Mineralogy* (2nd. Ed.) pp. 77–79 (1968), and in Van Olphen, *An Introduction to Clay Colloid Chemistry,* (2nd. Ed.) pp 64–76 (1977), both of which are incorporated by reference herein.

In general, there are two distinct classes of smectite clays that can be broadly differentiated on the basis of the number of octahedral metal-oxygen arrangements in the central layer for a given number of silicone/oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4Si_{8-y}Al_y(Mg_{6-x}Al_x)O_{20}$, sauconite $(OH)_4Si_{8-y}Al_y(Zn_{6-x}Al_x)O_2$, and vermiculite $(OH)_4Si_{8-y}Al_y(Mg_{6-x}Fe_x)O_{20}$, wherein y has a value of 0 to about 2.0 and x has a value of 0 to about 6.0.

The smectite minerals that are believed to be the most beneficial in fabric care and therefore more preferred when incorporated into detergent compositions are montmorillonites, hectorites and saponites, i.e. minerals of the structure $(OH)_4Si_{8-y}Al_y(Al_{4-x}Mg_x)O_{20}$, $(OH)_4Si_{8-y}Al_y(Mg_{6-x}Li_x)O_{20}$ and $(OH)_4Si_{8-y}Al_yMg_{6-x}Al_xO_{20}$ respectively in which the counter ions are predominantly sodium, potassium or lithium, more preferably sodium or lithium. Especially preferred are beneficated forms of such clays. Benefication of clay removes the various impurities such as quartz thereby providing enhanced fabric care performance. Benefication can take place by any of a number of methods known in the art. Such methods include a conversion of clay into a slip and then passing it through a fine sieve and also flocculating or precipitation of suspended clay particles by the addition of acids or other electro-negatively charged substances. These and other methods of beneficating clay are described in Grinshaw, *The Chemistry and Physics of Clay,* pp 525–27 (1971), which is incorporated by reference herein.

As noted hereinabove, the clay minerals employed in the compositions of the instant invention contain exchangeable cations including, but not limited to, protons, sodium ions, potassium ions, calcium ions, magnesium ions, lithium ions, and the like.

It is customary to distinguish between clays on the basis of one cation predominantly or exclusively adsorbed. For example, a sodium clay is one in which the adsorbed cation is predominantly sodium. As used herein, the term clay, such as a montmorillonite clay, includes all the various exchangeable cation variants of that clay, e.g. sodium montmorillonite, potassium montmorillonite, lithium montmorillonite, magnesium montmorillonite, calcium montmorillonite, etc.

Such adsorbed cations can become involved in exchange reactions with cations present in aqueous solutions. A typical exchange reaction involving a preferred smectite clay (montmorillonite clay) is expressed by the following equation:

$$\text{montmorillonite clay (Na)} + NH_4OH = \text{montmorillonite clay}(NH_4) + NaOH.$$

Since, in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g.). The cation exchange capacity of clays can be measured in several ways, including by electrodialysis, by exchange with ammonium ion followed by titration or by a methylene blue procedure, all of which are fully set forth in Grimshaw, *The Chemistry and Physics of Clays,* supra at 264–265, incorporated by reference herein. The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain smectite clays such as montmorillonites. Montmorillonites, hectorites and saponites all have exchange capacities greater than about 50 meq/100 g. and are therefore useful in the present invention. Illite clays, although having a three layer structure, are of a nonexpanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyls containing Al and Mg atoms.

Bentonite is a rock type clay originating from volcanic ash and contains montmorillonite (one of the preferred smectite clays) as its principal clay component. The following table shows that materials commercially available under the name bentonite can have a wide range of cation exchange capacities.

| Bentonite | Supplier | Exchange Capacity (meq/100 g.) |
|---|---|---|
| Brock | Georgia Kaolin Co. USA | 63 |
| Soft Clark | Georgia Kaolin Co. USA | 84 |
| Bentolite L | Georgia Kaolin Co. USA | 68 |
| Clarolite T-60 | Georgia Kaolin Co. USA | 61 |
| Granulare Naturale Bianco | Seven C. Milan Italy | 23 |
| Thixo-Jel #4 | Georgia Kaolin Co. USA | 55 |
| Granular Naturale Normale | Seven C. Milan Italy | 19 |
| Clarsol FB 5 | Ceca Paris France | 12 |
| PDL 1740 | Georgia Kaolin Co. USA | 26 |
| Versuchs Product FFI | Sud-Chemie Munich, Germany | 26 |

Some bentonite clays (i.e., those with cationic exchange capacity above about 50 meq/100 q.) can be used in the detergent compositions of the present invention.

It has been determined that illite, attapulgite, and kaolinite clays, with their relatively low ion exchange capacities, are not useful in the instant compositions. However, the alkali metal montmorillonites, saponites, and hectorites and certain alkaline earth metal varieties of these minerals, such as sodium hectorite, lithium hectorite, potassium hectorite etc., do meet the ion exchange capacity criteria set forth above and have been found to show useful fabric care benefits when incorporated in detergent compositions in accordance with the present invention.

Specific non-limiting examples of commercially-available smectite clay minerals which provide fabric care benefits when incorporated into the detergent compositions of the present invention include:

Sodium Hectorite
- Bentone EW
- Veegum F
- Laponite SP

Sodium Montmorillonite
- Brock
- Volclay BC
- Gelwhite GP
- Ben-A-Gel

Sodium Saponite
- Barasym NAS 100

Calcium Montmorillonite
- Soft Clark
- Gelwhite L

Lithium Hectorite
- Barasym LIH 200

It is to be recognized that such smectite minerals obtained under the foregoing tradenames can comprise mixtures of the various discrete mineral entities. Such mixtures of the smectite minerals are suitable for use herein.

Within the classes of montmorillonites, hectorite and saponite clay minerals having a cation exchange capacity of at least about 50 meq/100 g., certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in detergent softening composition. Imvite K is also very satisfactory.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e., they display swelling characteristics in aqueous media. Conversely they do not swell in nonaqueous or predominantly nonaqueous systems.

The clay-containing detergent compositions according to the invention contain up to 35%, preferably from about 4% to about 15%, especially from about 4% to about 12%, by weight of clay.

Enzymes are a preferred optional ingredient and are incorporated in an amount of from about 0.025% to about 2%, preferably from about 0.05% to about 1.5%. Preferred proteolytic enzymes should provide a proteolytic activity of at least about 5 Anson units (about 1,000,000 Delft units) per liter, preferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as "Savinase" and Alcalase" sold by Novo Industries and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al., issued July 18, 1978, and in U.S. Pat. No. 4,507,219, Hughes, issued Mar. 26, 1985, incorporated herein by reference.

OTHER OPTIONAL DETERGENT INGREDIENTS

Other optional ingredients which can be included in detergent compositions of the present invention, in their conventional art-established levels for use (generally from 0 to about 20%), include solvents, hydrotropes, solubilizing agents, suds suppressors, processing aids, soil-suspending agents, corrosion inhibitors, dyes, fillers, optical brighteners, germicides, pH-adjusting agents (monoethanolamine, sodium carbonate, sodium hydroxide, etc.), enzymes, enzyme-stabilizing agents, perfumes, non-peroxy bleaches, bleach stabilizers and the like.

Materials that provide clay soil removal/anti-redeposition benefits can also be incorporated in the detergent compositions of the invention. These clay soil removal/anti-deposition agents are usually included at from about 0.1 to about 10% by weight of the composition.

One group of preferred clay soil removal/anti-redeposition agents are the ethoxylated amines disclosed in European Patent Application No. 112,593, Vander Meer, published July 4, 1984, incorporated herein by reference. Another group of preferred clay soil removal/anti-redeposition agents are the cationic compounds disclosed in European Patent Application No. 111,965, Oh and Gosselink, published June 27, 1984, incorporated herein by reference. Other clay soil removal/anti-redeposition agents which can be used include the ethoxylated amine polymers disclosed in European Patent Application No. 111,984, Gosselink, published June 27, 1984; the zwitterionic compounds disclosed in European Patent Application No. 111,976, Rubingh and Gosselink, published June 27, 1984; the zwitterionic polymers disclosed in European Patent Application No. 112,592, Gosselink, published July 4, 1984; and the amine oxides disclosed in U.S. Pat. No. 4,548,744, Conner, issued Oct. 22, 1985, all of which are incorporated herein by reference.

Soil release agents, such as those disclosed in the art to reduce oily staining of polyester fabrics, may also be used in the compositions of the present invention. U.S. Pat. No. 3,962,152, issued June 8, 1976, Nicol et al., incorporated herein by reference, discloses copolymers of ethylene terephthalate and polyethylene oxide terephthalate as soil release agents. U.S. Pat. No. 4,174,305, issued Nov. 13, 1979, Burns et al., incorporated herein by reference, discloses cellulose ether soil release agents.

DETERGENT FORMULATIONS

Granular detergent compositions embodying the present invention can be formed by conventional techniques, i.e., by slurrying the individual components (with the exception of the imidazoline) in water and then atomizing and spray-drying the resultant mixture, or by pan or drum agglomeration of the ingredients. The imidazoline particles can be added directly or are preferably agglomerated as described above and admixed into the composition.

The detergent compositions of the invention are particularly suitable for laundry use, but are also suitable for the cleaning of hard surfaces and for dishwashing.

In a laundry method aspect of the invention, typical laundry wash water solutions comprise from about 0.1% to about 2% by weight of the detergent compositions of the invention. Fabrics to be laundered are agitated in these solutions to effect cleaning, stain removal, and fabric care benefits. The pH of a 0.1% by weight aqueous solution of this composition will be in the range of from about 7.0 to about 11.0, preferably from about 8.0 to about 11.0, and most preferably from about 9.0 to about 10.5.

All parts, percentages and ratios herein are by weight unless otherwise specified.

EXAMPLES

The following examples illustrate the present invention. The abbreviations used are:

| Code | Ingredient |
|---|---|
| $C_{13}$ LAS | sodium $C_{13}$ linear alkylbenzene sulfonate |
| $C_{45}$ AS | sodium $C_{14-15}$ alkyl sulfate |
| AES | $C_{14-15}$ alkyl ethoxy sulfate with an average of 2.25 ethoxylated groups |
| $C_{12}$ ABS | sodium $C_{12}$ alkyl benzene sulfonate |
| TAS | sodium tallow alkyl sulfate |
| NI | $C_{12-13}$ alkyl polyethoxylate 6.5 T<br>T = stripped of lower ethoxylated fractions and fatty alcohol |
| TMAC | $C_{12}$ trimethylammonium chloride |
| STPP | sodium tripolyphosphate (contains 4% pyrophosphate) |
| silicate | sodium silicate (1.6r) |
| carbonate | $Na_2CO_3$ |
| DTPA | sodium diethylene triamine pentaacetate |
| sulfate | sodium sulfate |
| PB1 | sodium perborate monohydrate |
| OBS | sodium nonyl oxybenzene sulfonate |
| Enzyme | Alcalase ® |
| Imidazoline | hydrogenated tallow amido ethyl-2-hydrogenated tallow imidazoline |
| soft imidazoline | tallow amido ethyl-2-tallow imidazoline (average particle size diameter approximately 70 microns) |
| coco imidazoline | coconut amido ethyl-2-coconut imidazoline (average particle size diameter approximately 70 microns) |
| clay | sodium montmorillonite |
| Misc | can include optical brightener, suds suppressor, dispersant, and anti-redeposition agents. |

EXAMPLE I

A granular laundry detergent composition of the present invention is made as follows:

The following components are combined and then spray dried in a conventional manner to form detergent premix.

| | Parts by Weight |
|---|---|
| LAS | 10.8% |
| AS | 10.8% |
| STPP | 44.2% |
| NI | 1.7% |
| DTPA | 1.8% |
| Silicate | 16.8% |
| Minors and mica ingredients | 3.4% |

-continued

| | Parts by Weight |
|---|---|
| Water | 10.5% |

The hydrogenated tallow amido ethyl-2-hydrogenated tallow imidazoline is processed by grinding large chunks of the material (obtained from Sherex Chemical Corporation, Dublin, Ohio as Varisoft ® 445 imidazoline) in an Osterizer ® blender Model 657A for about 120 seconds. The ground imidazoline is then sieved sequentially through a Tyler screen 150 (106 microns) and then through a Tyler screen 250 (63 microns). The fraction which remains on the 250 screen is retained. The average particle size of the fraction ranges from about 60 to about 80 microns (as determined by, for example, a Malvern ® 2600 particle size analyzer), and greater than 50% by weight of the particles fall within the range of about 20 to about 200 microns.

9.5 parts of these imidazoline particles are then added to 90.5 parts of the pre-mix and the resulting detergent composition is thoroughly mixed to insure even distribution.

The resulting detergent composition exhibits excellent cleaning and excellent fabric care benefits such as softness and static control.

EXAMPLES II–X

The following detergent compositions are representative of the present invention and are made as described above in Example I.

| | II | III | IV | V | VI | VII | VIII | IX | X |
|---|---|---|---|---|---|---|---|---|---|
| $C_{13}$LAS | 9.8 | 9.8 | 9.8 | 7.7 | 7.1 | 6.8 | 6.6 | 7.7 | 20.1 |
| $C_{45}$AS | 9.8 | 9.8 | 9.8 | 7.7 | 7.1 | 6.8 | 6.6 | 7.7 | — |
| NI | 1.5 | 1.5 | 1.5 | 1.2 | 1.1 | 1.1 | 1.0 | 1.2 | — |
| TMAC | — | — | — | — | — | — | — | 1.0 | — |
| STPP | 40.0 | 40.0 | 40.0 | 31.6 | 28.9 | 27.7 | 27.1 | 31.3 | 36.9 |
| Silicate | 15.2 | 15.2 | 15.2 | 12.0 | 11.0 | 10.5 | 10.3 | 11.9 | 5.7 |
| Carbonate | — | — | — | 20.8 | 16.0 | 14.5 | 14.2 | 20.6 | — |
| DTPA | 1.6 | 1.6 | 1.6 | 1.3 | 1.2 | 1.1 | 1.1 | 1.3 | — |
| Sulfate | — | — | — | — | — | — | — | — | 28.3 |
| PB1 | — | — | — | — | 4.9 | 5.0 | 4.9 | — | — |
| OBS | — | — | — | — | 6.8 | 6.8 | 6.7 | — | — |
| Enzyme | — | — | — | — | 0.6 | — | — | — | — |
| Clay | — | — | — | — | — | 4.7 | 6.5 | — | — |
| Imidazoline | 9.5 | 9.5 | 9.5 | 7.6 | 6.9 | 5.7 | 5.6 | 7.5 | 8.9 |
| Average Particle size of the imidazoline (microns) | 29 | 70 | 110 | 70 | 70 | 70 | 70 | 70 | 70 |
| Water and miscellaneous (including brightener, aesthetics) | | | | balance to 100 | | | | | |

EXAMPLES XI–XV

The following detergent compositions are representative of the present invention and are made as described above in Example 1.

| | XI | XII | XIII | XIV | IV |
|---|---|---|---|---|---|
| $C_{13}$ LAS | 9.8 | — | 9.8 | 9.4 | 3.8 |
| $C_{12}$ ABS | — | 17.6 | — | — | — |
| $C_{45}$ AS | 9.8 | — | 9.8 | 9.4 | — |
| TAS | — | — | — | — | 6.0 |
| AES | — | — | — | — | 6.0 |
| NI | 1.5 | — | 1.5 | 0.9 | 0.2 |
| TMAC | — | — | — | — | — |
| STPP | 40.0 | 24.8 | 40.0 | — | 36.8 |
| Silicate | 15.2 | 6.8 | 15.2 | 1.7 | 5.2 |
| Carbonate | — | — | — | 4.7 | 11.5 |
| Aluminosilicate | — | — | — | 23.0 | — |

-continued

| | XI | XII | XIII | XIV | IV |
|---|---|---|---|---|---|
| Sulfate | — | 37.3 | — | 33.3 | 16.1 |
| DTPA | 1.6 | — | 1.6 | — | — |
| PBI | — | — | — | — | — |
| OBS | — | — | — | — | — |
| Clay | — | 9.8 | — | — | — |
| Imidazoline approximately 70 microns) | — | 1.5 | — | 5.8 | 6.7 |
| Coco Imidazoline | 9.5 | — | — | — | — |
| Soft Imidazoline | — | — | 9.5 | — | — |

Substantially similar results are obtained when the imidazoline derivative of Example I is replaced, in whole or in part, with an equivalent amount of stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, and mixtures thereof.

Substantially similar results are also obtained when the mixed surfactant system of $C_{13}$ LAS and $C_{45}$ AS of Example I is replaced, in whole or in part, with an equivalent amount of other anionic surfactants, including, but not limited to, $C_8$–$C_{18}$ alkylbenzene sulfonates, $C_8$–$C_{18}$ alkyl sulfates, $C_{10}$–$C_{22}$ alkyl ethoxy sulfates, and mixtures thereof.

These compositions give excellent cleaning as well as excellent static control and softening benefits (without impairing cleaning).

What is claimed is:

1. A granular detergent composition comprising:

(a) from about 1% to about 95% of a surfactant selected from the group consisting of anionic surfactants, cationic surfactants, nonionic surfactants, zwitterionic surfactants, amphoteric surfactants and mixtures thereof; and (b) from about 0.5% to about 25% of particles having an average diameter of from about 50 to about 150 microns, consisting of an imidazoline compound having the formula:

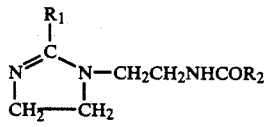

wherein each $R_1$ and $R_2$ can independently be $C_{12}$ to $C_{20}$ hydrocarbyl.

2. A granular detergent composition according to claim 1 wherein the surfactant component is an anionic surfactant.

3. A granular detergent composition according to claim 2 wherein said imidazoline particles have an average diameter of from about 50 to about 150 microns and wherein $R_1$ and $R_2$ are independently $C_{12}$ to $C_{20}$ alkyl or alkenyl.

4. A granular detergent composition according to claim 3 wherein $R_1$ and $R_2$ are independently $C_{14}$ to $C_{20}$ alkyl.

5. A granular detergent composition according to claim 4 wherein $R_1$ and $R_2$ are independently $C_{16}$ to $C_{20}$ alkyl.

6. A granular detergent composition according to claim 5 wherein $R_1$ and $R_2$ are independently $C_{16}$ to $C_{18}$ alkyl.

7. A granular detergent composition according to claim 6 wherein the pH of a 0.1% by weight aqueous solution of said composition is in the range of from about 7.0 to about 11.0.

8. A granular detergent composition according to claim 7 wherein the pH of said composition is from about 8.0 to about 11.0.

9. A granular detergent composition according to claim 8 wherein the pH of said composition is from about 9.0 to about 10.5.

10. A granular detergent composition according to claim 8 which comprises from about 1 to about 10% of the imidazoline component.

11. A granular detergent composition according to claim 10 which comprises from about 4 to about 8% of the imidazoline component and from about 10% to about 60% of the surfactant component.

12. A granular detergent composition according to claim 11 wherein the surfactant component is selected from the group consisting of alkylbenzene sulfonates, alkyl sulfates, alkyl ethoxy sulfates and mixtures thereof.

13. A detergent composition according to claim 12 wherein the imidazoline component is selected from the group consisting of stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut-amido ethyl-2-coconut imidazoline, tallow amido ethyl-2-tallow imidazoline and mixtures thereof.

14. A granular detergent composition according to claim 12 wherein said surfactant component is comprised of linear alkylbenzene sulfonates and alkyl sulfates wherein the weight ratio of linear alkylbenzene sulfonate to alkyl sulfate is from about 0.5:1 to about 3:1.

15. A detergent composition according to claim 14 wherein said ratio is from about 0.5:1 to about 2:1.

16. A granular detergent composition according to claim 15 wherein said imidazoline particles have an average diameter of from about 60 to about 125 microns.

17. A granular detergent composition according to claim 16 wherein said imidazoline particles have an average diameter of from about 60 to about 110 microns.

18. A detergent composition according to claim 17 additionally comprising from about 10% to about 80% of detergency builder.

19. A detergent composition according to claim 18 wherein the builder component is selected from the group consisting of inorganic phosphates, water-insoluble sodium aluminosilicates, silicates, carbonates, $C_{10}$–$C_{18}$ alkyl monocarboxylic acids, polycarboxylic acids, polymeric carboxylates, polyphosphonic acids, alkali metal, ammonium or substituted ammonium salts thereof, and mixtures thereof.

20. A detergent composition according to claim 19 wherein the builder component is an inorganic phosphate, alkali metal, ammonium or unsubstituted ammonium salt thereof.

21. A detergent composition according to claim 20 additionally comprising from about 0.1% to about 10% of a chelating agent.

22. A detergent composition according to claim 21 wherein the chelating agent is an amino carboxylate and comprises from about 0.75% to about 3.0% of the composition.

23. A detergent composition according to claim 22 wherein the imidazole component is selected from the group consisting of stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut-amido ethyl-2-coconut imidazoline, tallow amido ethyl-2-tallow imidazoline and mixtures thereof.

24. A detergent composition according to claim 23 wherein said chelating agent is selected from the group consisting of ethylenediaminetetraacetates, N-hydroxyethylethylenediaminetriacetates, nitrilotriacetates, ethylenediamine tetrapropionates, triethylenetetraaminehexaacetates, dimethylenetriaminepentaacetates, and ethanoldiglycines, alkali metal, ammonium or substituted ammonium salts thereof, and mixtures thereof.

25. A detergent composition according to claim 22 additionally comprising from about 1% to about 20% by weight of inorganic or organic peroxy bleaching agent.

26. A detergent composition according to claim 25 which comprises from about 1% to about 10% of the bleaching agent.

27. A detergent composition according to claim 26 wherein said bleaching agent is comprised of from about 1.0% to about 60% of the peroxygen bleaching compound and from about 0.5% to about 40% by weight of a bleach activator.

28. A detergent composition according to claim 27 wherein the bleach activator has the general formula:

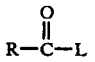

wherein R is an alkyl group containing from about 6 to about 12 carbon atoms wherein the longest linear alkyl chain extending from and including the carboxyl carbon contains from about 5 to about 10 carbon atoms and L is a leaving group, the conjugate acid of which has a logarithmic acidity constant in the range from about 4 to about 13.

29. A detergent composition according to claim 28 wherein the peroxygen bleaching compound is sodium perborate monohydrate and the bleach activator is sodium nonyl oxybenzene sulfonate.

30. A detergent composition according to claim 19 which additionally comprises from about 4% to about 15% of a smectite clay.

31. A detergent composition according to claim 25 additionally comprising from about 4% to about 15% of a smectite clay.

32. A detergent composition according to claim 30 wherein the clay component comprises from about 4% to about 12% of the composition and is selected from the group consisting of sodium hectorite, potassium hectorite, lithium hectorite, magnesium hectorite, calcium hectorite, sodium montmorillonite, potassium montmorillonite, lithium montmorillonite, magnesium montmorillonite, calcium montmorillonite, sodium saponite, potassium saponite, lithium saponite, magnesium saponite, calcium saponite, and mixtures thereof.

33. A detergent composition according to claim 31 wherein the clay component comprises from about 4% to about 12% of the composition and is selected from the group consisting of sodium hectorite, potassium hectorite, lithium hectorite, magnesium hectorite, calcium hectorite, sodium montmorillonite, potassium montmorillonite, lithium montmorillonite, magnesium montmorillonite, calcium montmorillonite, sodium saponite, potassium saponite, lithium saponite, magnesium saponite, calcium saponite, and mixtures thereof.

34. A detergent composition according to claim 33 wherein the imidazoline component is selected from the group consisting of stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut-amido ethyl-2-coconut imidazoline, tallow amido ethyl-2-tallow imidazoline, and mixtures thereof.

35. A detergent composition according to claim 30 which further comprises from about 0.025% to about 2.0% of a protealytic enzyme.

36. A detergent composition according to claim 31 which further comprises from about 0.025% to about 2.0% of a protealytic enzyme.

37. A method for laundering fabrics comprising the agitation of said fabrics in an aqueous solution containing from about 0.1% to about 2% of the composition of claim 1.

38. A method for laundering fabrics comprising the agitation of said fabrics in an aqueous solution containing from about 0.1% to about 2% of the composition of claim 19.

39. A method for laundering fabrics comprising agitation of said fabrics in an aqueous solution containing from about 0.1% to about 2% of the composition of claim 30.

40. A method for laundering fabrics comprising agitation of said fabrics in an aqueous solution containing from about 0.1% to about 2% of the composition of claim 31.

* * * * *

UNITED STATES PATENT AND TRADEMARK OFFICE

CERTIFICATE OF CORRECTION

PATENT NO. : 4,770,815

DATED : September 13, 1988

INVENTOR(S) : Ellen S. Baker, Roy C. Mast, Frederick A. Hartman, James R. Tucker It is certified that error appears in the above-identified patent and that said Letters Patent are hereby corrected as shown below:

Column 16, lines 9-15, the formulas should read

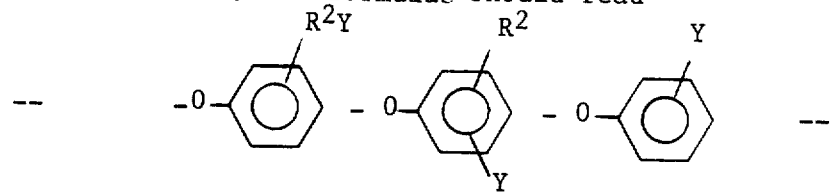

Column 18, line 35, "silicone/oxygen" should read --silicon/oxygen--.

Column 18, line 51, "silicone-oxygen" should read --silicon/oxygen--.

Signed and Sealed this

Eighteenth Day of April, 1989

*Attest:*

DONALD J. QUIGG

*Attesting Officer*

*Commissioner of Patents and Trademarks*